US006699094B1

(12) United States Patent
Ward

(10) Patent No.: US 6,699,094 B1
(45) Date of Patent: Mar. 2, 2004

(54) TOY FIGURINE FLASHLIGHT

(76) Inventor: Marian J. Ward, 151 Arvin Ct., Havelock, NC (US) 28532

( * ) Notice: Subject to any disclaimer, the term of this patent is extended or adjusted under 35 U.S.C. 154(b) by 0 days.

(21) Appl. No.: 10/460,909

(22) Filed: Jun. 13, 2003

(51) Int. Cl.[7] ..... A63H 30/00
(52) U.S. Cl. ..... 446/175; 446/297; 446/376
(58) Field of Search ..... 446/97, 130, 175, 446/219, 297, 298, 300, 303, 330, 351, 354, 376, 390, 391, 392, 397, 484; 362/253, 276, 802, 105

(56) References Cited

U.S. PATENT DOCUMENTS

| | | | | | |
|---|---|---|---|---|---|
| 844,577 | A | * | 2/1907 | Borchardt | 446/371 |
| 3,239,961 | A | * | 3/1966 | Forkner | 446/130 |
| 3,531,890 | A | * | 10/1970 | Citron | 446/300 |
| 4,298,915 | A | | 11/1981 | Goldfarb et al. | |
| 4,752,273 | A | | 6/1988 | Woods | |
| 4,802,879 | A | * | 2/1989 | Rissman et al. | 446/175 |
| 4,874,343 | A | * | 10/1989 | Rosenthal | 446/175 |
| 4,878,873 | A | * | 11/1989 | Yamaguchi et al. | 446/321 |
| 5,267,886 | A | | 12/1993 | Wood et al. | |
| 5,434,761 | A | | 7/1995 | Lesnick et al. | |
| 5,501,627 | A | * | 3/1996 | Ekstein | 446/175 |
| 5,902,166 | A | | 5/1999 | Robb | |
| 5,989,091 | A | * | 11/1999 | Rodgers | 446/153 |
| 6,095,661 | A | | 8/2000 | Lebens et al. | |
| 6,109,763 | A | | 8/2000 | Ohta et al. | |
| 2002/0118535 | A1 | | 8/2002 | Nostrant | |

* cited by examiner

*Primary Examiner*—Jacob K. Ackun
*Assistant Examiner*—Bena B. Miller
(74) *Attorney, Agent, or Firm*—Dale J. Ream

(57) ABSTRACT

A toy figurine flashlight includes a figurine body representative of a cartoon figure having a torso with a helmet and having arms and legs coupled to the torso. The toy includes a power source in the torso. A tri-colored LED unit is mounted in the helmet for projecting light through a helmet opening, the LED unit being capable of selectably emitting at least three different colors. A first switch is mounted on the torso and is electrically connected to the power source for selectively permitting current from the power source to energize the LED unit. A second light source is mounted to a light diffusing cape, the cape including a male electrical connector. A socket is situated on the torso and is electrically connected to the power source for delivering current to the second light source when the male connector is coupled to the socket.

20 Claims, 5 Drawing Sheets

TOY FIGURINE FLASHLIGHT

BACKGROUND OF THE INVENTION

The present invention relates generally to toy flashlights and, more particularly, to a toy figurine flashlight having a body representative of a cartoon figure with audio and visual functionality for providing security to a child at nighttime.

It is common for children to be afraid of the dark and even to fear they may be harmed by monsters or the "boogey man" looming in the darkness. As a result, a child may desire to leave the lights on or to utilize a nightlight so as to avoid the darkness or unknown predators lurking therein. Although nightlights and similar devices may be effective, the existing devices do not inspire the confidence that a child often needs to fully overcome the anxiety of this phobia.

Therefore, it would be desirable to have a toy figurine flashlight having the form of a cartoon super-hero to inspire confidence in a young child. Further, it would be desirable to have a figurine flashlight that can operate as a conventional flashlight or, alternately, can emit lights and sounds representative of attacking a nighttime predator such as the "boogey man".

SUMMARY OF THE INVENTION

A toy figurine flashlight for use as a children's nighttime security aid includes a figurine body in a form representative of a cartoon super-hero. The figurine body includes a helmet positioned atop a torso member with a pair of arms and a pair of legs coupled to the torso member. A pivotal helmet is mounted atop the torso member. A power source is positioned within the torso body and may be a battery, generator, or a magnet and electrical coil assembly. A tri-color LED unit is mounted within the helmet for projection of light through a helmet opening. An activation switch on the torso member selectively permits the power source to energize the light source.

The arms are connected to the power source as mode selection and LED color selection switches for varying the functionality of the device. Further, the toy flashlight includes a cape having another light source and a male electrical connector which may selectively mate with a socket on the torso member. The socket is electrically connected to the power source for energizing the second light source when the connector is coupled to the socket. This second light source acts as a nightlight.

Therefore, a general object of this invention is to provide a toy figurine flashlight for providing assurance to a child in the dark at nighttime.

A further object of this invention is to provide a toy figurine flashlight, as aforesaid, which is constructed to represent a cartoon superhero having a helmet mounted atop a torso member with arms and legs coupled to the torso member.

Another object of this invention is to provide a toy figurine flashlight, as aforesaid, which includes a first light source that projects light through a helmet opening in the manner of a flashlight.

Still another object of this invention is to provide a toy figurine flashlight, as aforesaid, which includes a second light source mounted to a cape for selective electrical connection to the power source.

A still further object of this invention is to provide a toy figurine flashlight, as aforesaid, which includes a logic circuit capable of operating the first light source according to a plurality of modes of operation upon operation of modal and color selector switches.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
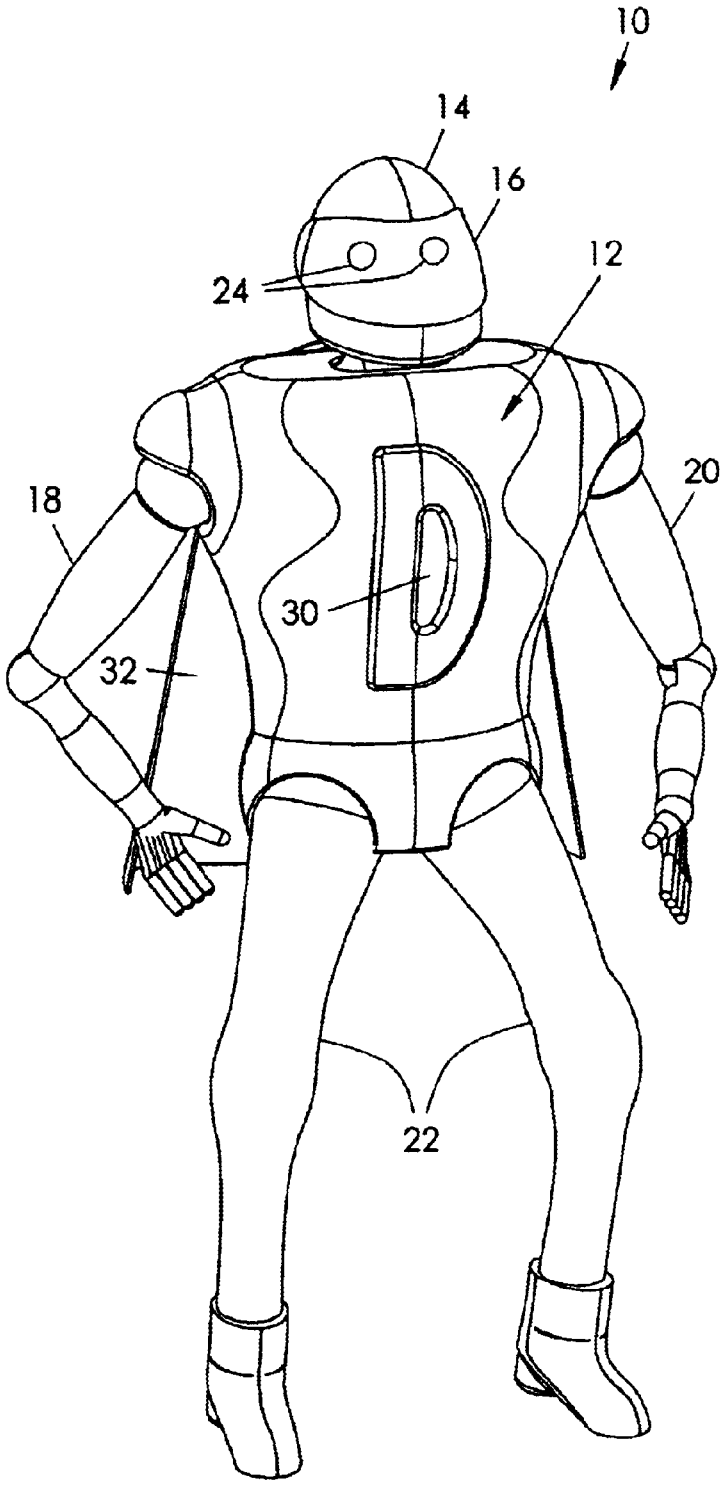
FIG. 1 is a perspective view of a toy figurine flashlight according to a preferred embodiment of the present invention.

A toy figurine flashlight 10 according to a preferred embodiment of the present invention is shown in FIGS. 1 through 5 of the accompanying drawings. The toy figurine flashlight 10 includes a figurine body having a torso member 12 constructed in a form representative of a cartoon super-hero (FIG. 1). The figurine body may be in the form of a strong, powerful, and even magical "destroyer of the boogey man" so as to instill confidence in a young child at nighttime. More particularly, the figurine body includes a helmet 14 pivotally mounted atop the torso member 12 and includes first 18 and second 20 arms and a pair of legs 22 coupled to the torso member 12. The functionality of the arms 18, 20 will be described in greater detail later.

A first light source 24 is positioned within the helmet 14 (FIG. 1). Preferably, the first light source 24 is a tri-colored LED unit that is capable of alternately emitting at least three different colors. Specifically, the tri-color LED may include red and green LED's within a single package which can be energized singly or in combination to produce at least three different colors. The helmet 14 defines a frontal opening which may be covered by a pivotally mounted lens 16 or shield (FIG. 1). The lens 16 is selectively movable between a first configuration covering the light emitted by the first light source 24 and a second configuration displaced from the path of light emitted by the first light source. The lens 16 is generally transparent but may be colored or translucent to render a desired lighting effect.

Figure 3:
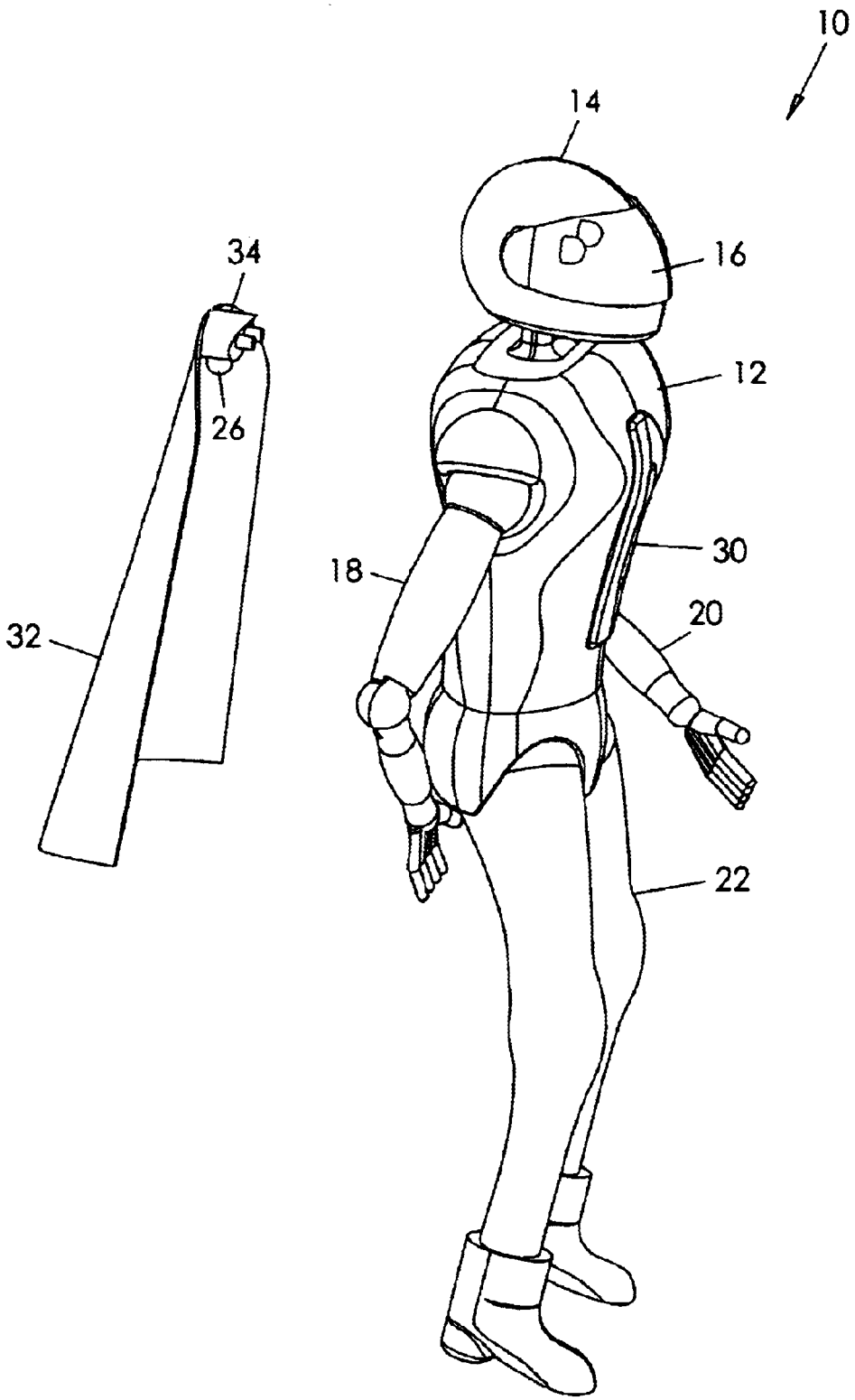
FIG. 3 is a perspective view of the toy figurine flashlight as in FIG. 1 with a cape in a detached configuration.
Figure 4:
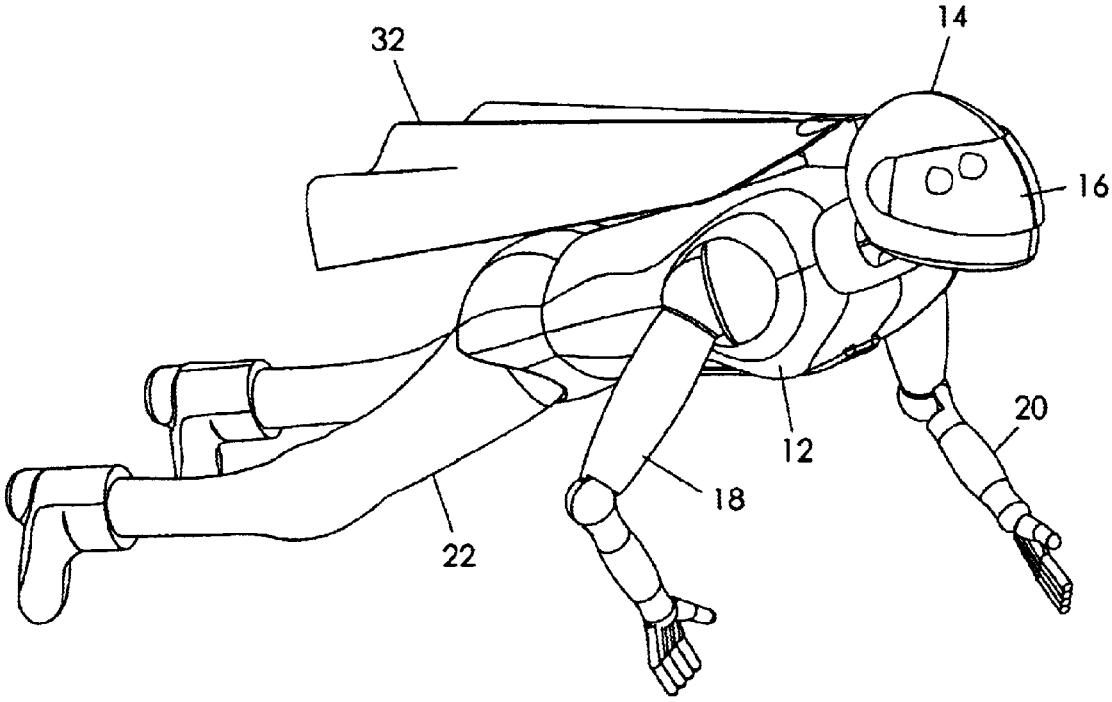
FIG. 4 is another perspective view of the toy figurine flashlight as in FIG. 1 with the helmet pivoted to a second configuration.

The helmet 14 is pivotally mounted atop the torso member 12 for selective movement between a first configuration in which the path of light projected through the frontal opening is generally perpendicular to a longitudinal axis defined by the torso member (FIG. 1) and a second configuration in which the path of light projected through the frontal opening is generally in-line with the torso member longitudinal axis (FIG. 4). This construction enables a user to direct the path of light emitted by the tri-colored LED in a conventional flashlight manner (FIG. 4) or in an action figure format (FIG. 3).

A power source 28 (FIG. 5) is positioned with the torso member 12 and is electrically connected to the first light source 24. While the power source 28 may be a conventional battery, it is preferable that the power source be one that will not periodically have to be replaced. Therefore, the power source 28 may be a conventional generator having a shaft that produces electric current upon rotation of the shaft. The shaft may be connected to one of the arms of the figurine body and the arm may be pivotally connected to the torso member 12 for rotation by a user. Similarly, the legs 22 may include a ratchet and freewheel assembly for turning the shaft by repeatedly squeezing the legs together.

However, the preferred power source includes a magnet 28*a* enclosed within a tube that is wrapped with wire coils 28*b*. According to Faraday's Law, a magnet moving through an electrical coil generates an electrical current. Therefore, a user may shake the figurine body such that the magnet 28*a* is moved in a relative back and forth movement in the wire coil 28*b* so as to generate electric current. A capacitor 29 is connected to the electric coils, or other current generating mechanism as the case may be, for storing generated current.

An activation switch 30 is mounted on the front of the torso member 12 in the form of a push-button (FIG. 1) and is electrically connected to the power source 28. The activation switch 30 is capable of selectively permitting or blocking the flow of current from the power source 28 to the first light source 24. Therefore, a user is able to activate the tri-colored LED for use as a flashlight upon depression of the activation switch 30. The function of the activation switch 30, however, may be modified by operation of an internal logic circuit, as will be described in more detail later.

Figure 5:
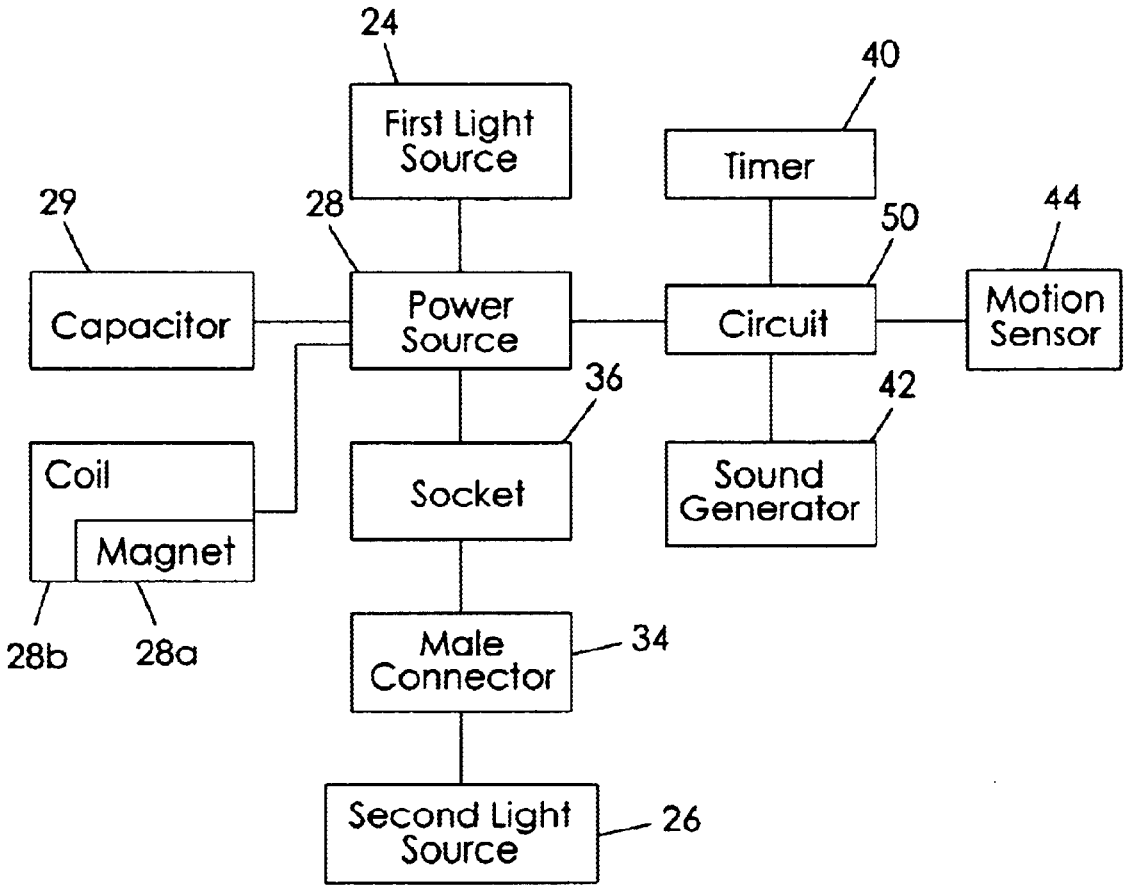
FIG. 5 is a block diagram of the electronic components positioned within the torso member of the toy figurine flashlight.

The figurine toy flashlight 10 includes a generally translucent cape 32 constructed to represent a cartoon superhero's cape (FIG. 3). The cape 32 is constructed of a thin plastic or other light diffusing material. A male electrical connector 34 is mounted to an inner surface of the cape 32 adjacent an upper edge thereof. A second light source 26, such as an LED, is electrically connected to the male connector 34. A socket 36 is positioned on a back surface of the torso member 12 of the figurine body, the socket 36 being electrically connected to the power source 28 (FIG. 5). Therefore, the second light source 26 may be energized by current from the power source 28 when the male connector 34 is coupled to the socket 36. In use, the second light source 26 may be utilized as a reassuring nightlight.

The second arm 20 is movable between at least three configurations associated with the at least three colors that may be emitted by the tri-colored LED. The second arm 20, therefore, is electrically connected to the power source 28 and first light source 24 and functions as a color selector switch. Therefore, a user may select which color is emitted by the first light source 24 by movement of the second arm 20.

Figure 2:
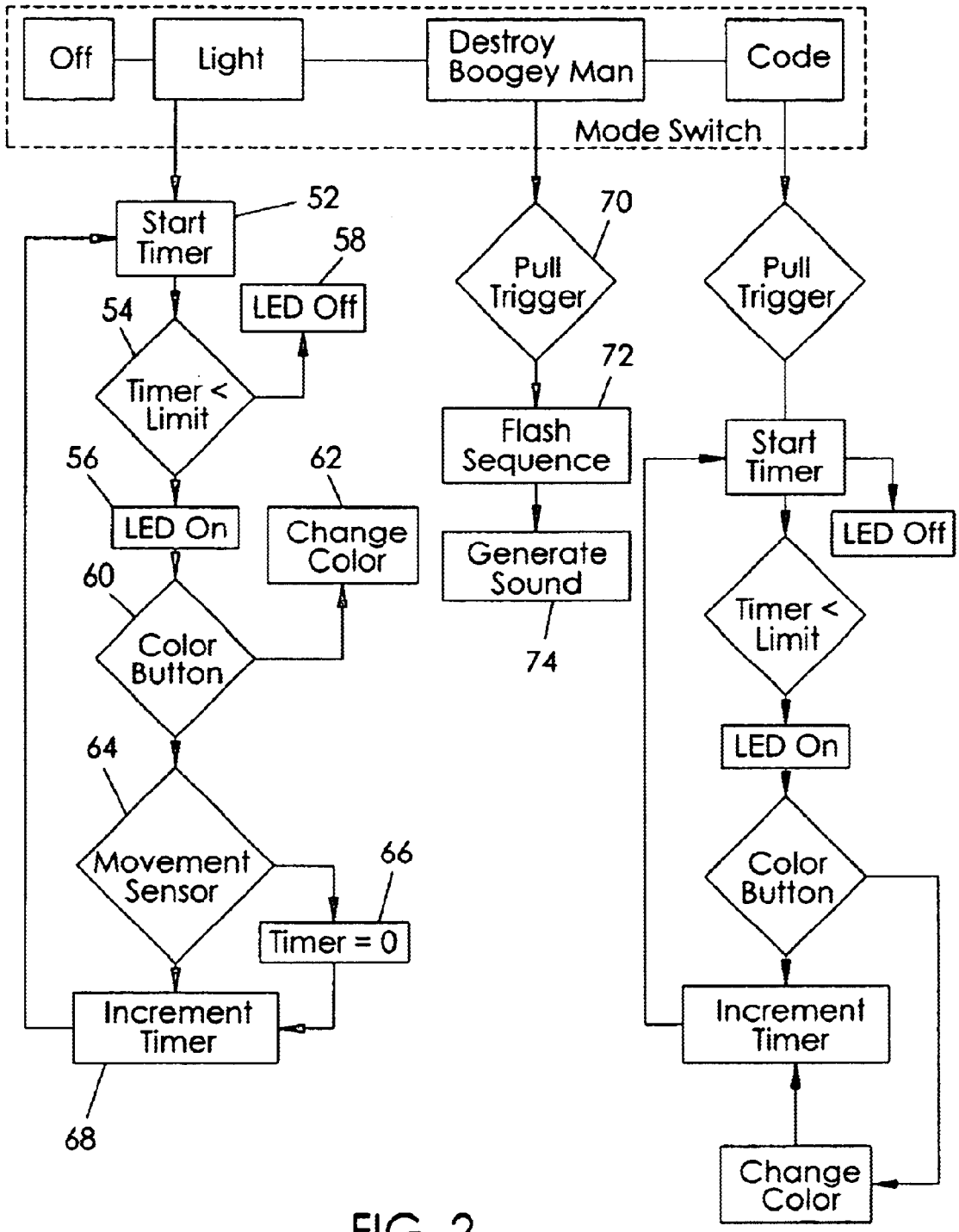
FIG. 2 is a flowchart showing the logic performed by an electric circuit of the toy figurine flashlight.

An electrical circuit 30 is positioned within the torso member 12 and is electrically connected to the power source 28 (FIG. 5). The logic performed by the circuit 30 is illustrated in FIG. 2 and is described in greater detail below. The first arm 18 is pivotally coupled to the torso member 12 for movement between at least three configurations for selecting between at least three modes of operation of the circuit. The first arm 18, therefore, operates as a mode selector switch. Timer circuitry (i.e. a timer) 40 is electrically connected to the circuit 30, as is a sound generator 42 and motion sensor 44 (FIG. 5), as to be described below. When the first arm 18 is at a first configuration corresponding to a first mode, the circuit 30 automatically energizes the timer 40 to initiate a timer for a predetermined amount of time 52. So long as the predetermined time has not reached the predetermined amount of time 54, the first power source 28 (i.e. tri-color LED) is energized 56, otherwise the circuit 30 will not permit current to energize the LED and it is deactivated 58. Also while time remains, the second arm 20 (i.e. color selector switch) may be utilized by a user to alternate the emitted color, as indicated by reference numerals 60 and 62 (FIG. 5). However, if the motion sensor 44 detects movement of the torso member 12, as indicated by reference numeral 64, the timer 40 is reset to zero 66. Otherwise, the timer is incremented 68 and the loop described above is repeated.

A second mode of operation is executed by the circuit 30 when the first arm 18 (i.e. mode selector switch) is pivoted set at a second configuration. In this mode, an operation 70 of the activation switch 30 (i.e. push button on torso) enables the circuit 30 to permit current to flow to the first light source 24 so as to cause the tri-colored LED to emit a predetermined light flash 72 (FIG. 2). This action also causes the circuit 30 to energize the sound generator 42, as indicated by reference numeral 74. Preferably, the sound generator 42 emits a predetermined voice message although emitting another sound or sound sequence would also be suitable.

The circuit 30 operates according to a third mode of operation when the first arm 18 (i.e. mode selector switch) is positioned at a third configuration (FIG. 2). This mode operates in a manner substantially similar to that of the first mode of operation described above, except that the motion sensor 44 is not effective. Also, the timer 40 is not automatically initiated upon activation of the mode selector switch, but rather upon operation of the activation switch 30.

In use, a child is able to use the toy figurine flashlight 10 in many ways to gain confidence, courage, and reassurance of safety at nighttime. In a first mode, the first light source 24 is activated for a predetermined amount of time and the child has control over the color selection using the color selector switch. In a third mode, the first light source 24 is activated when the child depresses the activation switch 30. This enables the user to operate the device in a manner similar to a conventional flashlight. The helmet 14 may be pivotally positioned by the user to direct light in a desired direction. If the mode selector switch is positioned in another configuration, the user may activate the activation switch 30 to initiate a light and sound sequence, whereby to kill the "boogey man". The cape 32 may be coupled to the torso member 12 via a coupling of the male connector 34 and socket 36 so as to energize the second light source 26 as a nightlight for added comfort and confidence.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A toy figurine flashlight for use as a children's nighttime security aid, comprising:

a figurine body defining a representation of a cartoon figure having a torso member with a helmet defining a front opening, said figurine body having first and second arms coupled to said torso member and legs depending from said torso member;

a power source positioned in said torso member;

a first light source electrically connected to said power source and positioned in said helmet so as to project light through said front opening when energized; and a first switch for selectively permitting current from said power source to energize said first light source.

2. The toy figurine flashlight as in claim 1 wherein said first light source is a tri-colored LED unit capable of selectably emitting at least three different colors.

3. The toy figurine flashlight as in claim 2 wherein said first arm is a movable selector switch electrically connected to said tri-colored LED unit for selecting one of said at least three different colors.

4. The toy figurine flashlight as in claim 1 wherein said power source is a battery.

5. The toy figurine flashlight as in claim 1 wherein said power source comprises:

a generator positioned in said torso member and having a shaft, said generator being capable of generating electric current when said shaft is rotated;

means connected to said torso member and coupled to said generator for selectably rotating said shaft; and a capacitor electrically connected to said generator for storing said generated electric current.

6. The toy figurine flashlight as in claim 1 wherein said power source comprises:

a plurality of metal wires having a tubular configuration positioned in said torso member;

a magnet mounted for relative back and forth movement within said plurality of wires for generating electric current in said plurality of wires; and a capacitor electrically connected to said plurality of metal wires for storing said generated electric current.

7. The toy figurine flashlight as in claim 1 wherein said helmet is pivotally coupled to said torso member for movement between a first configuration in which said opening of said helmet defines a first light-projection path generally perpendicular to a longitudinal axis defined by said torso member and a second configuration in which said opening defines a second light-projection pathway generally in-line with said longitudinal axis.

8. The toy figurine flashlight as in claim 1 further comprising a generally translucent lens pivotally coupled to said helmet for movement between a first configuration covering said light source and a second configuration displaced from said light source.

9. The toy figurine flashlight as in claim 1 further comprising:

a light diffusing cape having a generally rigid construction;

a male connector mounted to an inner surface of said cape;

a second light source electrically connected to said male connector; and wherein a back portion of said torso member includes a socket electrically connected to said power source for selectably mating with said male connector for supplying current to said second light source when said male connector is coupled to said socket.

10. A toy figurine flashlight for use as a children's nighttime security aid, comprising:

a figurine body defining a representation of a cartoon figure having a torso member with a helmet defining a front opening, said figurine body having first and second arms coupled to said torso member and legs depending from said torso member;

a power source positioned in said torso member;

a first light source electrically connected to said power source and positioned in said helmet so as to project light through said front opening when energized;

an electronic circuit positioned in said torso member and electrically connected to said power source, said circuit having a plurality of operation modes;

wherein said first arm is a mode selector switch electrically connected to said circuit, said mode selector switch being movable between at least three configurations for selection of a respective operation mode;

an activation switch on said torso member and electrically connected to said power source for permitting current from said power source to energize said first light source when said mode selector switch is in a first configuration; and timer means in said circuit for preventing current from flowing from said power source to said first light source after a predetermined amount of time when said mode selector switch is in said first configuration.

11. The toy figurine flashlight as in claim 10 wherein said first light source is a tri-colored LED unit capable of selectably emitting at least three different colors.

12. The toy figurine flashlight as in claim 11 wherein said second arm is a color selector switch electrically connected to said LED and movable between at least three configurations for selectively alternating between said at least three different colors when said mode selector switch is in said first configuration.

13. The toy figurine flashlight as in claim 10 further comprising:

a motion sensor electrically connected to said circuit; and means in said circuit for resetting said timer means upon sensing a movement of said torso member when said mode selector switch is in said first configuration.

14. The toy figurine flashlight as in claim 10 further comprising:

a sound generator electrically connected to said circuit; and means in said circuit for energizing said sound generator for emitting a predetermined sound sequence when said mode selector switch is at a second configuration and said activation switch is manipulated.

15. The toy figurine flashlight as in claim 10 wherein said power source is a battery.

16. The toy figurine flashlight as in claim 10 wherein said power source comprises:

a generator positioned in said torso member and having a shaft, said generator being capable of generating electric current when said shaft is rotated;

means connected to said torso member and coupled to said generator for selectably rotating said shaft; and a capacitor electrically connected to said generator for storing said generated electric current.

17. The toy figurine flashlight as in claim 10 wherein said power source comprises:

a plurality of metal wires having a tubular configuration positioned in said torso member;

a magnet positioned for relative back and forth movement within said plurality of wires for generating electric current in said plurality of wires; and a capacitor electrically connected to said plurality of metal wires for storing said generated electric current.

18. The toy figurine flashlight as in claim 10 wherein said helmet is pivotally coupled to said torso member for movement between a first configuration in which said opening of said helmet defines a first light-projection path generally perpendicular to a longitudinal axis defined by said torso member and a second configuration in which said opening defines a second light-projection pathway generally in-line with said longitudinal axis.

19. The toy figurine flashlight as in claim 10 further comprising:

a light diffusing cape having a generally rigid construction;

a male connector mounted to an inner surface of said cape;

a second light source electrically connected to said male connector; and wherein a back portion of said torso member includes a socket electrically connected to said power source for selectably mating with said male connector for supplying current to said second light source when said male connector is coupled to said socket.

20. A toy figurine flashlight for use as a children's nighttime security aid, comprising:

a figurine body defining a representation of a cartoon figure having a torso member with a helmet defining a front opening, said figurine body having first and second arms coupled to said torso member and legs depending from said torso member;

a power source positioned in said torso member;

a first light source electrically connected to said power source and mounted to said helmet so as to project light through said front opening when energized, said first light source is a tri-colored LED unit capable of selectably emitting at least three different colors;

a first switch for selectively permitting current from said power source to energize said first light source;

a light diffusing cape having a generally rigid construction;

a male connector mounted to an inner surface of said cape;

a second light source electrically connected to said male connector;

wherein a back portion of said torso member includes a socket electrically connected to said power source for selectably mating with said male connector for supplying current to said second light source when said male connector is coupled to said socket.

* * * * *